US007278287B2

(12) United States Patent
Bohner et al.

(10) Patent No.: US 7,278,287 B2
(45) Date of Patent: Oct. 9, 2007

(54) APPARATUS FOR SHAPING METAL SHEETS

(75) Inventors: Friedrich Bohner, Oerlinghausen (DE); Andreas Schiwek, Paderborn (DE); Werner Böhmer, Willebadessen (DE); Martin Koyro, Paderborn (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 0 days.

(21) Appl. No.: 11/279,173

(22) Filed: Apr. 10, 2006

(65) Prior Publication Data

US 2006/0230806 A1 Oct. 19, 2006

(30) Foreign Application Priority Data

Apr. 19, 2005 (DE) ..... 10 2005 018 240

(51) Int. Cl.
*B21D 37/16* (2006.01)

(52) U.S. Cl. ..... 72/342.96; 72/342.94

(58) Field of Classification Search ..... 72/342.1, 72/342.5, 342.6, 342.7, 342.8, 342.92, 342.94, 72/342.96; 148/640
See application file for complete search history.

(56) References Cited

U.S. PATENT DOCUMENTS 2,893,459 A * 7/1959 Kosek ..... 72/342.92
3,724,253 A * 4/1973 Revell et al. ..... 72/253.1
3,783,669 A * 1/1974 Furney, Jr. ..... 72/342.8
3,926,029 A * 12/1975 Abson et al. ..... 72/342.92
5,737,954 A * 4/1998 Yasui ..... 72/60
5,916,389 A 6/1999 Lundström
6,550,302 B1 * 4/2003 Ghosh ..... 72/342.8

FOREIGN PATENT DOCUMENTS

| | | | |
|---|---|---|---|
| DE | 890 035 | | 7/1949 |
| DE | 101 62 441 | A1 | 7/2003 |
| GB | 1 490 535 | | 11/1977 |
| JP | 2-99226 | * | 4/1990 |

* cited by examiner

*Primary Examiner*—Ed Tolan
(74) *Attorney, Agent, or Firm*—Henry M. Feiereisen

(57) ABSTRACT

Apparatus for shaping metal sheets including a shaping tool having an forming space for receiving a metal sheet. At least one heating element is disposed in a recess of the shaping tool for heating at least a portion of the metal sheet, whereby an insulation layer is provided to insulate the heating element from neighboring walls of the shaping tool.

14 Claims, 1 Drawing Sheet

APPARATUS FOR SHAPING METAL SHEETS

CROSS-REFERENCES TO RELATED APPLICATIONS

This application claims the priority of German Patent Application, Serial No. 10 2005 018 240.2, filed Apr. 19, 2005, pursuant to 35 U.S.C. 11 9(a)-(d), the content of which is incorporated herein by reference.

BACKGROUND OF THE INVENTION

The present invention relates, in general, to an apparatus for shaping metal sheets.

Nothing in the following discussion of the state of the art is to be construed as an admission of prior art.

British patent specification no. GB 1 490 535 A describes a hot forming process for shaping metal sheets, whereby a metal sheet such as a steel blank is heated and subsequently placed in a pressing tool in which the blank is formed. Hardening takes place while the blank remains still in the pressing tool.

Certain hot-formed steel, in particular of high-strength steel, used for example in B columns (center pillars) of motor vehicles, are normally cut along their edges to maintain the predetermined dimensional tolerance. Moreover, many structures are perforated after the hot forming process. As the hot forming process results in a very hard martensitic configuration, the use of cutting knives to realize the edge cutting and/or perforation of the formed products is wear-intensive and cost-intensive. Other cutting methods, e.g. using laser, are also very cost-intensive.

Thus, it is desirable to provide the concerned areas softer in order allow cuffing the border or making holes. One approach suggests subjecting the hot-formed part to an additional heat treatment to thereby soften up the material structure in those areas that need to be refinished. The need for an additional process step is accompanied however by an increase in costs so that the overall production becomes inefficient. Another approach suggests configuring the hot forming and hardening processes in such a manner that those areas that need refinishing works are cooled down at a slower pace. This approach runs however counter to conventionally designed hot forming tools that are constructed to achieve a quickest possible cool down. An example of this approach is disclosed in U.S. Pat. No. 5,916,389 which describes a press tool provided with inserts or additional heating elements to effect a reduced cooling action in targeted areas during hardening so that the material in these areas becomes softer at the conclusion of the process.

German Offenlegungsschrift DE 101 62 441 A1 describes a method of making motor vehicle parts of sheet metal in a shaping tool, whereby the material flow is controlled by targeted tempering through introducing and/or removing heat. This approach suffers shortcomings because it is very difficult to realize widely different cooling gradients in small transition zones, i.e. within few millimeters, between hard and soft regions in one and the same structural part.

It would therefore be desirable and advantageous to provide an improved apparatus for shaping metal sheets to obviate prior art shortcomings and to enable realization of widely different cooling gradients within narrow boundaries of a formed part.

SUMMARY OF THE INVENTION

According to one aspect of the present invention, an apparatus for shaping metal sheets includes a shaping tool having an forming space for receiving a metal sheet, at least one heating element, disposed in a recess of the shaping tool, for heating at least a portion of the metal sheet, and an insulation layer for insulating the heating element from the shaping tool.

The present invention resolves prior art problems by heat-insulating the heating element in its entirety or in sections thereof from adjacent walls of the shaping tool. In this way, the efficiency of the heating element can be enhanced by specifically targeting the heat transmission to particular narrow local zones of the shaped structure. As a result, the material structure of the shaped part can be influenced much better, and a flow of heat to neighboring regions of the shaping tool is prevented. The heated regions of the formed part during shaping operation thus do not cool down during the hardening process while the formed part is still in the shaping tool. Only after the shaping tool is opened can these regions cool down through exposure to air, however at a significantly slower cool down speed. As a consequence of the slower cool-down speed, no martensitic structure is obtained in these previously heated regions of the formed part. The hardness in these regions of the formed part resembles a material structure that has not been subjected to a heat treatment so that subsequent processing steps, such as cutting or perforation operations, are now easier to execute and are more efficient to produce higher quality formed products. Tools, such as blades, knives, or punching tools, used for these finishing procedures undergo much less wear and have a significantly longer service life.

In accordance with the invention, the structure of the material of a formed part can be treated within very narrow boundaries by a heat forming process through the inventive and novel tailored and targeted heating of the formed part during shaping operation. Targeted regions of the formed part or sheet metal blank can be maintained at an elevated temperature during shaping operation and allowed to subsequently undergo a comparably slow cool down through exposure to air. In this way, the region that needs aftertreatment has a soft structure that can easily be cut or punched.

According to another feature of the present invention, several such heating elements may be integrated in the shaping tool, with each heating element being heat-insulated from neighboring walls of the shaping tool by the insulating layer to thereby prevent flow of heat onto the shaping tool, and transferring heat predominantly towards the tool surface only. The configuration of the heating element(s) is suited geometrically to temper those targeted regions of the formed part that need to remain soft. The shaping tool may therefore have indentations, grooves or similar recesses for accommodating a heating element. For example, the insulating layer may be provided between the heating element and the bottom of the recess, or the insulating layer may be disposed between the heating element and sidewalls of the recess.

According to another feature of the present invention, the insulating layer may be made of ceramic material, or mica, or glass fiber material. Another example may include the implementation of the insulating layer by way of an air gap, because air has generally good insulating or heat insulating properties. Of course, a combination of an insulating layer material and an air gap may be possible as well. Suitably, the material for the insulating layer may have a thermal conductivity of $\geqq 10$ W/Km.

Examples of a heat source may include an electric heating element, e.g. a high-capacity heating cartridge, or tubes through which a heating fluid flows. Care should be taken to provide sufficient power density in order to be able to heat large-area tool regions.

According to another feature of the present invention, a shield may be provided for separating the heating element from the forming space. Suitably, the shield encloses the heating element and the insulating layer to separate them from the forming space so that the tool surface on which the sheet metal blank slides during the forming process can be configured homogeneously. The shield may be made of a material with good thermal conductivity, e.g. copper. This ensures that heat is transmitted in the direction of the formed part in the forming space. Suitably, the material of the shield has a thermal conductivity of $\geqq 10$ W/Km. Copper has for example a thermal conductivity $\lambda$ of 394 W/km. Of course, the shield may also be made of iron which has a thermal conductivity k of 73 W/km.

In accordance with the present invention, all sides of the heating element are intended to be heat insulated from the shaping tool, i.e. at the bottom as well as sidewalls. Depending on the situation at hand, it may be sufficient to provide heat insulation of the heating element only on the bottom side or only on the sidewalls.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
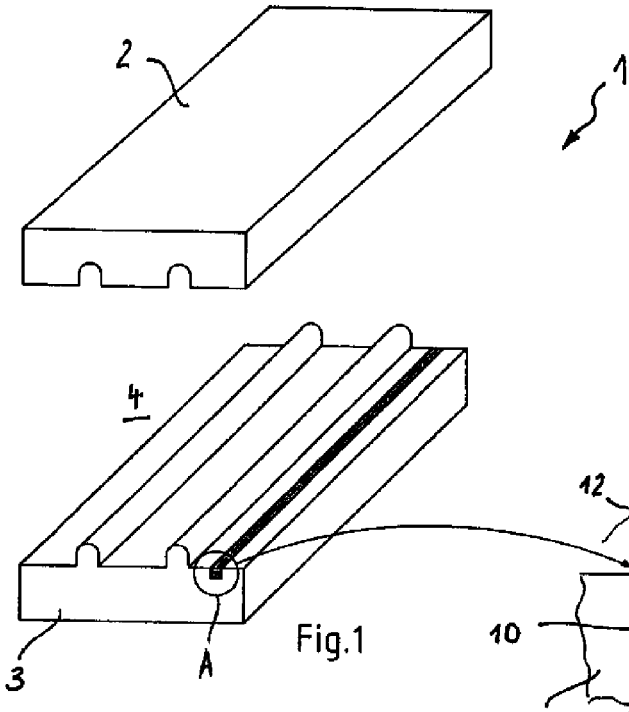
FIG. 1 is a simplified perspective illustration of a portion of a shaping tool with integrated heating element in accordance with the present invention.

Throughout all the Figures, same or corresponding elements are generally indicated by same reference numerals. These depicted embodiments are to be understood as illustrative of the invention and not as limiting in any way. It should also be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown a simplified perspective illustration of a portion of a shaping tool, generally designated by reference numeral 1 and representing a press for example. The shaping tool 1 in general has an upper platen 2 and a lower platen 3 which have a complementary configuration. Defined between the upper and lower platens 2, 3 is a forming space 4 for receiving a sheet metal blank which is heated beforehand to a certain shaping temperature. As the upper and lower platens 2, 3 are moved together, the sheet metal blank is shaped according to the configuration of the forming space 4. While still clamped in the shaping tool 1, the formed part is cooled down and hardened to thereby provide the formed part with a martensitic structure.

Figure 2:
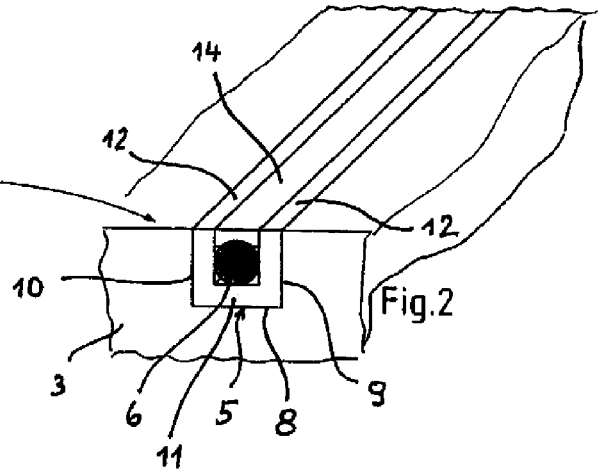
FIG. 2 is a detailed cutaway view on an enlarged scale of the area A encircled in FIG. 1.

To attain a softer structure in targeted regions, the press formed part is heated in these regions by a heating element 6 which is disposed in a pocket or recess 5 of the shaping tool 1, as shown in particular in FIG. 2 which is an enlarged detailed view of the area A encircled in FIG. 1. In the non-limiting example of FIG. 2, the heating element 6 has a circular cross section and a length which is freely selectable depending on the demands at hand. The heating element 6 is made suitably of flexible structure so it can be bent, if necessary, to be able to provide heating action also along curved tool regions. The heating element 6 is separated and heat-insulated from neighboring sidewalls 8, 9, 10 of the lower platen 3 of the shaping tool 1 by insulating layers 11, 12. The insulating layer 11 is disposed here underneath the heating element 6 at the bottom wall 8 of the recess 5, and the insulating layer 12 is disposed along the sidewalls 9, 10 of the recess 5 and extends to the rim of the lower platen 3. Both insulating layers 11, 12 may be made of ceramic, or mica, or glass fiber material (glass fiber mat). Of course, the insulation may also be realized by a single insulating layer sandwiched between the heating element 6 and the neighboring walls 8, 9, 10 of the recess 5 of the lower platen 3.

Toward the top of the forming space 4, the heating element 6 is covered by a shield 14 which is made of a material having good thermal conductivity, such as copper. The material for the shield 14 should have a thermal conductivity $\lambda$ of equal or greater than 10 W/Km.

Figure 3:
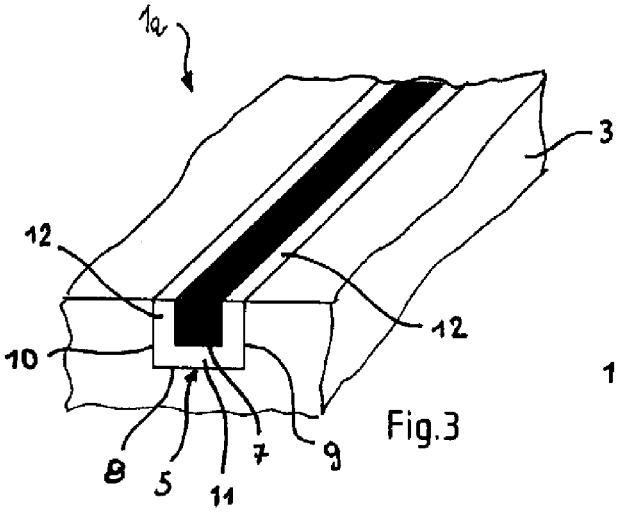
FIG. 3 is a perspective view of another embodiment of a shaping tool according to the present invention.

Referring now to FIG. 3, there is shown a perspective view of another embodiment of a shaping tool according to the present invention, generally designated by reference numeral 1*a*. Parts corresponding with those in FIG. 2 are denoted by identical reference numerals and not explained again. The description below will center on the differences between the embodiments. In this embodiment, provision is made for a heating element 7 which is received in the recess 5 of the lower platen 3 and has a square cross section with an edge length of, for example, 4 mm to 8 mm. Of course, this length of the heating element 7 can be selected to the requirements at hand. The heating element 7 may also be made of flexible material to suit curved tool regions that need to be heated. The heating element 7 is surrounded by insulating layers 11, 12, as described above with reference to FIG. 2, to heat-insulate the heating element 7 at the bottom 8 and against the sidewalls 9, 10 of the recess 5.

Figure 4:
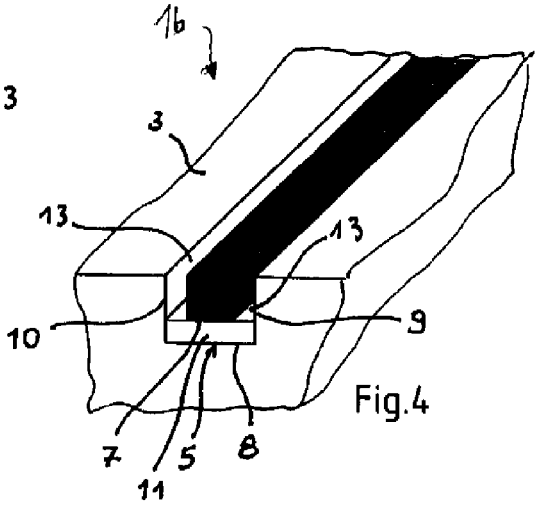
FIG. 4 is a perspective view of yet another embodiment of a shaping tool according to the present invention.

FIG. 4 shows a perspective view of yet another embodiment of a shaping tool according to the present invention, generally designated by reference numeral 1*b*. Parts corresponding with those in FIGS. 2 and 3 are denoted by identical reference numerals and are not explained again. The description below will focus on the differences between the embodiments. In this embodiment, the insulating layer 11 of ceramic, mica, of glass fiber material is integrated in the bottom wall 8 of the recess 5 which receives the heating element 7. A further insulating layer 13 in the form of an air gap is placed between the heating element 7 and the sidewalls 9, 10 of the recess 5 to realize the heat insulation effect. In other words, the heating element 7 is sized to allow spacing between the sides of the heating element 7 and the adjacent sidewalls 9, 10 of the lower platen 3.

The provision of the heating elements 6, 7, as described with reference to FIGS. 1-4, allows a targeted tempering of the formed part in the forming space 4. The separation and heat insulation of the heating elements 6, 7 from the shaping tool 1, 1*a*, 1*b*, respectively, prevent a detrimental heat conduction into the shaping tool so that the formed part can be heated effectively. Even extremely varying cool-down gradients within few millimeters only of the formed part can be realized. The targeted regions heated of the formed part in the shaping tool 1, 1*a*, 1*b* do not cool down or at most cool down insignificantly while the shaping tool is clamped and closed. When the shaping tool 1 is opened, the formed part is then able to cool down through exposure to the ambient air at slow cool-down speed. As a consequence of this slow cool-down, the previously heated regions exhibit a softer material structure so that cutting or perforating operations can be executed easier and more precise while subjecting the tools to much less wear.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. Apparatus for shaping metal sheets, comprising:

a shaping tool having an forming space for receiving a metal sheet;

at least one heating element, disposed in a recess of the shaping tool, for heating at least a portion of the metal sheet:

an insulation layer for insulating the heating element from the shaping tool; and a shield, made of a material having a thermal conductivity of ≧10 W/Km, for separating the heating element from the forming space.

2. The apparatus of claim 1, wherein the shield is made of copper.

3. The apparatus of claim 1, wherein the shield is made of iron.

4. The apparatus of claim 1, wherein the heating element is an electric heating element.

5. The apparatus of claim 1, wherein the heating element is a high-capacity heating cartridge.

6. The apparatus of claim 1, wherein the heating element is constructed in the form of tubes integrated in the shaping tool for passage of a heating fluid.

7. The apparatus of claim 1, wherein the shield is placed directly adjacent the heating element.

8. The apparatus of claim 1, wherein the insulating layer is provided between the heating element and the bottom of the recess.

9. The apparatus of claim 1, wherein the insulating layer is disposed between the heating element and sidewalls of the recess.

10. The apparatus of claim 1, wherein the insulating layer is made of ceramic material.

11. The apparatus of claim 1, wherein the insulating layer is made of mica.

12. The apparatus of claim 1, wherein the insulating layer is made of glass fiber material.

13. The apparatus of claim 1, wherein the insulating layer is realized by an air gap.

14. The apparatus of claim 1, wherein the insulating layer has a thermal conductivity of ≧10 W/Km.

* * * * *